US008960283B2

(12) United States Patent
Rondeau et al.

(10) Patent No.: US 8,960,283 B2
(45) Date of Patent: Feb. 24, 2015

(54) DAMPER CARTRIDGE FOR LAUNCHING PLUGS IN CEMENTING OPERATIONS

(75) Inventors: Joel Rondeau, Antony (FR); Philippe Gambier, La Defense (FR); André Salvaire, Singapore (SG); Greg Giem, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 824 days.

(21) Appl. No.: 13/133,268

(22) PCT Filed: Dec. 1, 2009

(86) PCT No.: PCT/EP2009/008657

§ 371 (c)(1), (2), (4) Date: Feb. 16, 2012

(87) PCT Pub. No.: WO2010/069478

PCT Pub. Date: Jun. 24, 2010

(65) Prior Publication Data

US 2012/0160482 A1 Jun. 28, 2012

(30) Foreign Application Priority Data

Dec. 19, 2008 (EP) ..... 08172471

(51) Int. Cl.
*E21B 43/00* (2006.01)
*E21B 33/16* (2006.01)
*E21B 34/14* (2006.01)

(52) U.S. Cl.
CPC ..... *E21B 33/16* (2013.01); *E21B 34/14* (2013.01)
USPC ..... 166/265; 166/285; 166/386; 166/156

(58) Field of Classification Search
CPC ..... E21B 34/14; E21B 33/16; E21B 33/12; E21B 33/13; E21B 33/134; E21B 43/00; E21B 33/03; E21B 33/05
USPC ..... 166/265, 285, 383, 291, 386, 153–156
See application file for complete search history.

(56) References Cited

U.S. PATENT DOCUMENTS 5,890,537 A * 4/1999 Lavaure et al. ..... 166/285
6,196,325 B1 * 3/2001 Connell et al. ..... 166/377

FOREIGN PATENT DOCUMENTS

WO 99/24692 5/1999

OTHER PUBLICATIONS

International search report for the equivalent PCT patent application No. PCT/EP2009/008657 issued on Jun. 21, 2011.

* cited by examiner

*Primary Examiner* — Yong-Suk (Philip) Ro
(74) *Attorney, Agent, or Firm* — Michael Dae

(57) ABSTRACT

An apparatus for use in launching cement plugs in a well cementing operation comprises a cylinder, a piston slideably received in the bore of the cylinder and an actuator extending from the piston through the cylinder. The actuator is operable by the piston for launching plugs from the apparatus into the well. A resilient damper cartridge is slideably mounted on the actuator in the cylinder so as to be contactable by the piston. A series of frangible pins is located in the cylinder wall so as to provide temporary limits to the movement of the cartridge in the cylinder as the piston slides along the cylinder.

20 Claims, 10 Drawing Sheets

DAMPER CARTRIDGE FOR LAUNCHING PLUGS IN CEMENTING OPERATIONS

TECHNICAL FIELD

This invention relates to apparatus and methods for launching plugs in cementing operations of the type found when constructing wells in the oil and gas industry. In particular, the invention relates to the use of a latching mechanism for controlling the movement of a piston in a plug launcher.

BACKGROUND ART

In the construction of oil and gas wells, it is occasionally necessary to cement a liner or casing in the well to provide stability and zonal isolation. In such processes, it is common to use plugs to separate different fluids pumped along the tubing or casing. Such plugs are usually installed in a basket located in cementing equipment lowered into the well. The plugs are launched from the basket by means of darts pumped from the surface.

A known cement plug launching tool (see U.S. Pat. No. 5,890,537) is shown in FIGS. 1-3. The body 32 of the launching tool includes an upper tubular housing 40 whose upper end is threaded to the mandrel of the liner setting tool, and whose lower end is threaded at 41 to a spacer tube 42. A sleeve valve 44 which is slidable in the bore of the housing 40 is biased upward to a normally open position with respect to ports 38 by a coil spring 46.

A piston 50 connected to a drive rod 36 slides in the bore of the spacer tube 42 which is connected to the upper end of a cylinder tube 55. A lower piston 58 is formed on the rod 36 and slides within the bore 60 of the cylinder tube 55 which is filled with a suitable hydraulic oil. The piston 58 has an outer diameter that provides a selected clearance with respect to the wall of the bore 60 such that, as the piston is forced downward with the rod 36, a metering effect is created which retards the rate of downward movement.

The lower end of the cylinder tube 55 is connected to the upper end of the basket 33 which initially houses the upper and lower wiper plugs 34, 35, and is provided with a plurality of longitudinal slots 68 that receive radial stop pins 70 which extend from the outer periphery of a drive flange 75 that rests on top of the upper plug 34. A head 71 on the upper end of the upper plug 34 receives the inner ends of several radially extending shear pins 73 on the drive flange 75 to releasably couple the plug 34 to the flange.

In operation and use, the liner is run and suspended by a hanger from a point near the lower end of the casing which is below the wellhead. The plug launcher tool is connected to the lower end of the mandrel, and the wiper plugs 34 and 35 were previously loaded into the basket 33. The drive rod 36 is in its upper position where the piston 58 is at the upper end of the oil chamber 60. The ports 38 in the housing 40 are open so that fluids can flow therethrough. A dart launcher is provided at the surface.

In order to cement the liner in place, cement slurry is pumped in through the dart launcher, and then a valve is opened to release a lower dart 101. Pressure is applied to the top of the dart 101 to force it through the valve and down into the drill pipe ahead of the cement. Eventually the dart 101 enters the housing 40, passes into the bore of the valve sleeve 44, and to a position where its nose bumps against the drive head 50 of the rod 36. Since the elastomer cups of the dart 101 seal off the bore of the valve sleeve 44, pressure causes the sleeve valve to shift downward against the bias of the coil spring 46, and in so doing, partially close off the radial ports 38.

Pressure on the dart 101 applies downward force to the rod 36 and causes it to shift downward in the body 32, thereby driving both the upper and lower wiper plugs 34 and 35 downward. Such movement is slowed by the action of hydraulic oil that meters upward through the clearance between the piston 58 and the inner wall of the cylinder 60 so that shock loads are dissipated. When the pins 70 on the drive plate 75 reach the bottoms of the slots 68 as shown in FIG. 2, downward movement of the upper plug 34 is stopped. However the lower plug 35 will have been ejected from the bottom of the basket 33 and into the bore of the liner. At about the same time as the stop pins 70 encounter the bottoms of the slots 68, the top cup of the dart 101 clears the bottom of the sleeve valve 44 so that the ports 38 are re-opened as the sleeve valve is shifted upward by the coil spring 46. Pumping of cement is continued until the desired number of barrels of cement has been placed within the liner.

When the proper amount of cement has been pumped into the running string, the upper dart 100 is forced into the drill pipe, followed by whatever fluid is being pumped behind it. The dart 100 travels down through the running string, the mandrel, and into the housing 40. When the cups of the dart 100 enter the valve sleeve 44 and seal off its bore, the valve sleeve shifts downward to close off the lateral ports 38. The dart 100 then engages the lower dart 101, so that applied pressures force the drive rod 36 further down in the body 32 as shown in FIG. 3. The pins 73 are sheared so that the drive disc 66 on the lower end of the rod 32 passes through the plate 75 and forces ejection of the upper wiper plug 34 from the bottom of the basket 33. The metering of oil past the piston 58 again slows or retards downward movement of the rod 32 so that ejection is smoothed. When the top end of the dart 100 clears the bore of the valve sleeve 44, the valve sleeve again opens, as before, so that displacement fluids flow around the outside of the launcher assembly and through the annular space between the basket 33 and the inner wall of the liner. A positive indication of the launching of wipers plugs 34 and 35 from basket 33 is shown by an increase in pumping pressure at the surface location resulting from the cushioned travel of piston 58 for both plugs 34 and 35. The shearing of pins 73 for upper plug 34 additionally increases the pumping pressure for upper plug 34. For example, the increase in the pumping pressure may amount to about 1500 psi (103.42 bars) for lower plug 35 and to about 3000 psi (206.84 bars) for upper plug 34.

As is discussed above, the piston 58 and oil chamber 60 act to damp the motion of the rod when the dart lands, giving a steady action and pressure indication as the rod forces the plug from the basket. However, at the end of each operation, the piston and chamber must be re-set and any maintenance can involve draining the oils from the chamber and disassembling the piston. This is time consuming and complex, necessitating removal of the equipment from the rig site. It is an object of the invention to avoid such problems by providing a replaceable cartridge that can easily be installed at the rig site

DISCLOSURE OF THE INVENTION

A first aspect of the invention provides an apparatus for use in launching cement plugs in a well cementing operation, comprising:

a cylinder;

a piston slideably received in the bore of the cylinder; and an actuator extending from the piston through the cylinder and operable by the piston for launching a plug from the apparatus into the well; wherein a resilient damper cartridge is slideably mounted on the actuator in the cylinder so as to be contactable by the piston, and a series of frangible pins is located in the cylinder wall so as to provide temporary limits to the movement of the cartridge in the cylinder as the piston slides along the cylinder.

By providing the damper in the form of a cartridge (dashpot) that is located on the actuator, and the use of frangible pins (shear pins) it is a relatively easy job to re-set the apparatus for use by replacing any parts. The problems associated with the previous systems are therefore avoided.

The apparatus typically further comprises a basket that houses at least two cement plugs, the pins being positioned so as to limit movement of the cartridge after each plug is launched from the basket. The shear pins can be replaced after use.

The apparatus is preferably configured such that the piston can move from a first position in which the plugs are located in the basket to an intermediate position in which a first plugs has been ejected from the basket; and from the intermediate position to a final position in which a second plug has been ejected from the basket; the pins being positioned so as to temporarily hold the piston at the first, intermediate and second positions until sheared by application of pressure to the piston.

The apparatus is typically arranged to be connected to a tubular pipe such that one or more darts can be pumped into contact with the piston to apply pressure thereto.

A second aspect of the invention provides a damper cartridge for use in the first aspect of the invention, the cartridge comprising a resilient body having a central bore through which the actuator can project, and further including upper and lower contact surfaces for contacting the piston and pins respectively.

Preferably, the cartridge comprises an upper flange that in use is contacted by the piston, and a lower flange that contacts the pins as the cartridge moves along the cylinder. A compression spring can be wound around the cartridge between the two flanges.

Further aspects of the invention will be apparent from the following description.

MODE(S) FOR CARRYING OUT THE INVENTION

Figure 1:
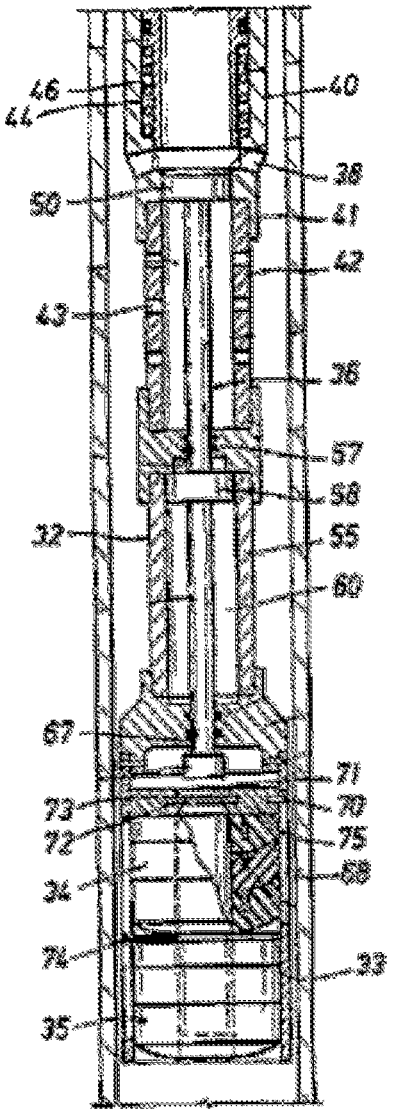
Figure 1 PRIOR ART
FIGS. 1-3 show operation of a prior art system.
Figure 2:
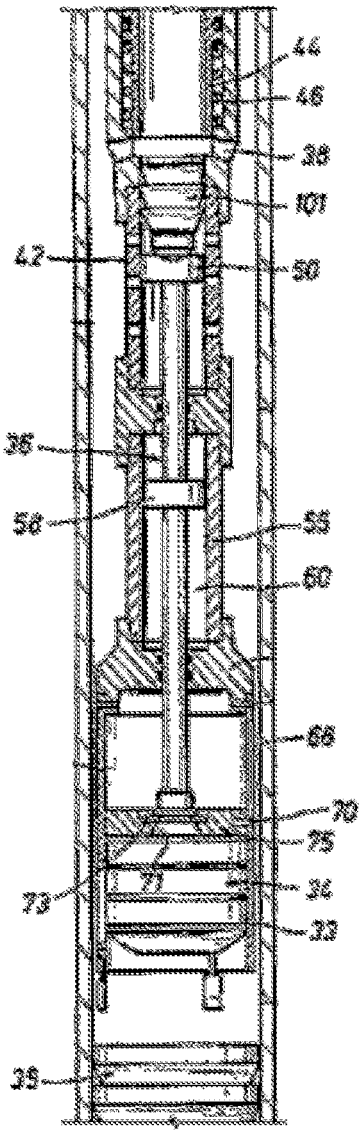
Figure 2 PRIOR ART
Figure 3:
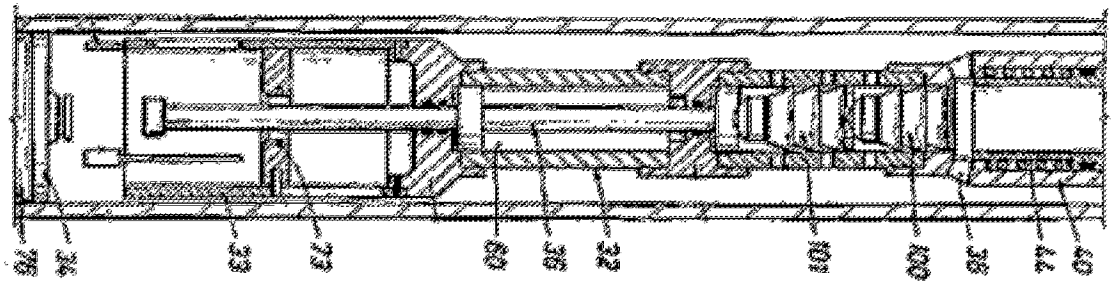
Figure 3 PRIOR ART

This invention provides a piston system that replaces that shown in FIGS. 1-3 discussed above. In particular, the piston and cylinder arrangement 58, 60, and the shear pin and slots 68, 70 of FIGS. 1-3 are replaced by the system described below.

Figure 4:
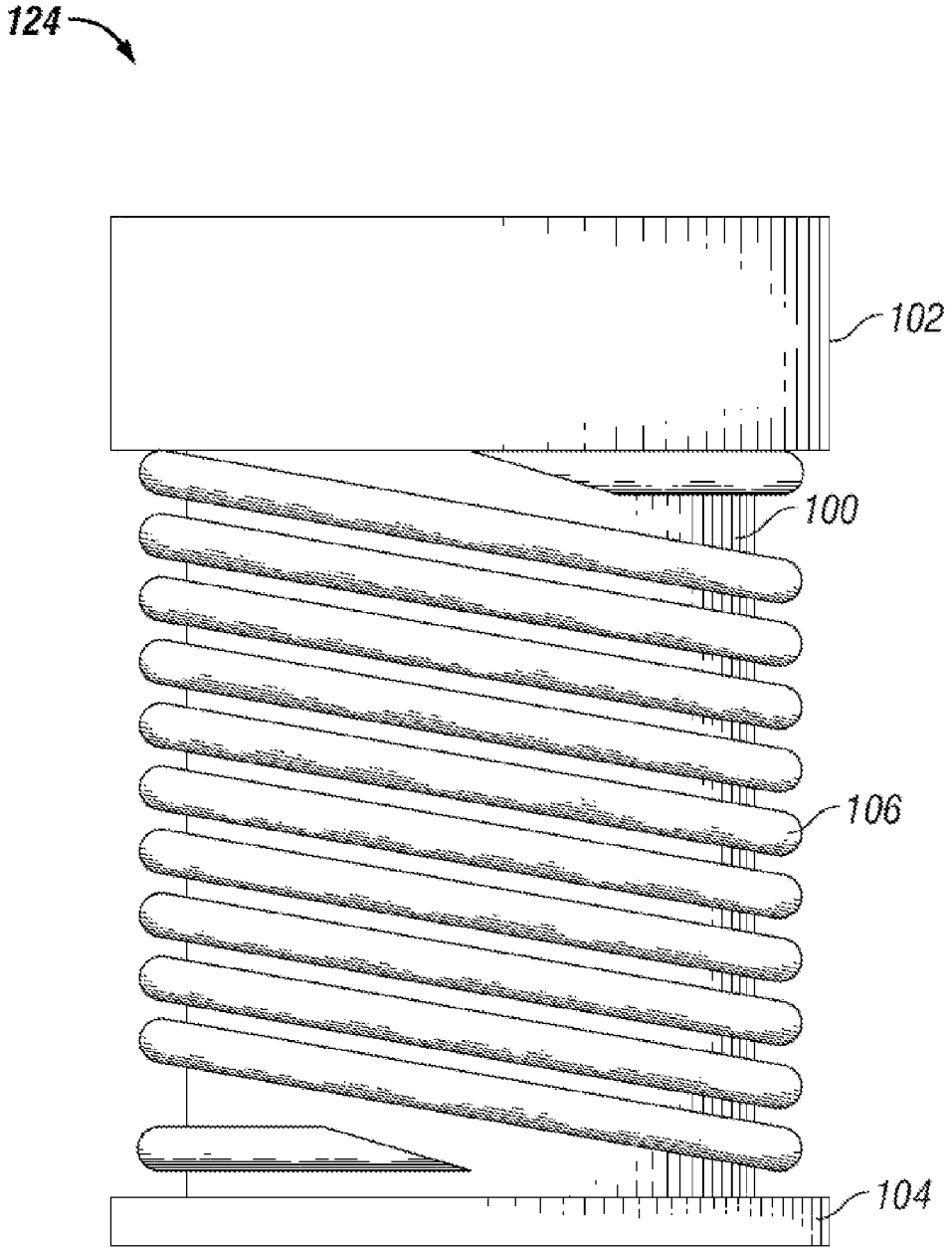
FIG. 4 shows a dashpot cartridge for use in the present invention.
Figure 5:
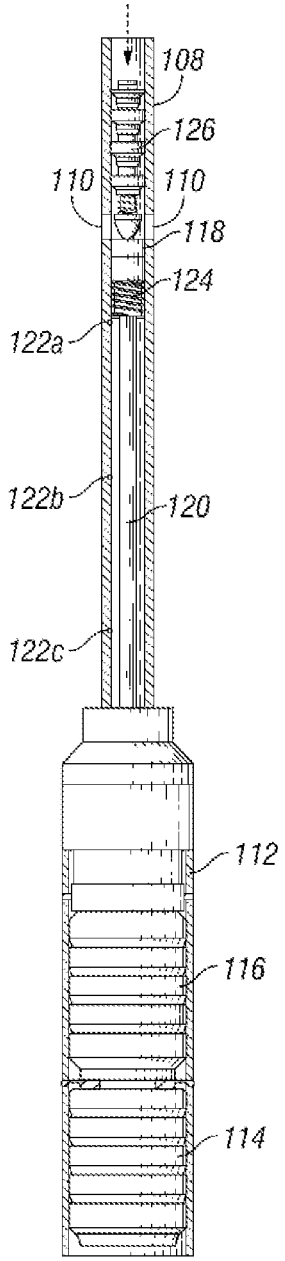
FIGS. 5-10 show various positions of operation of a launching system according to the invention.
Figure 6:
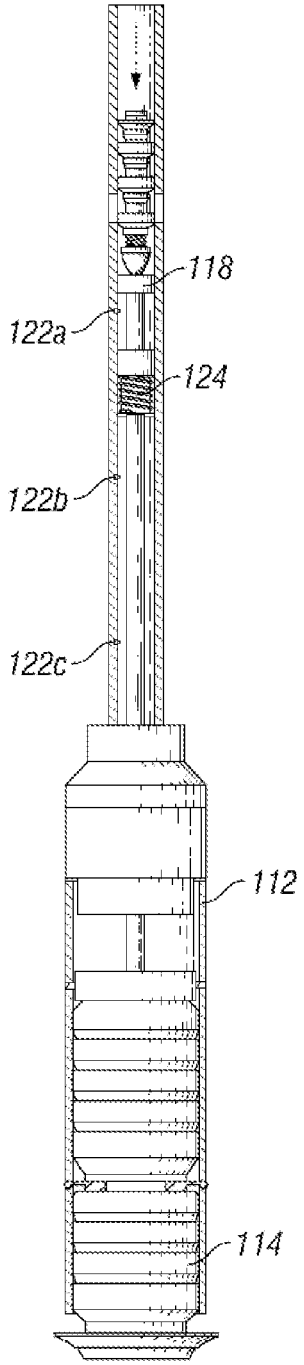
Figure 7:
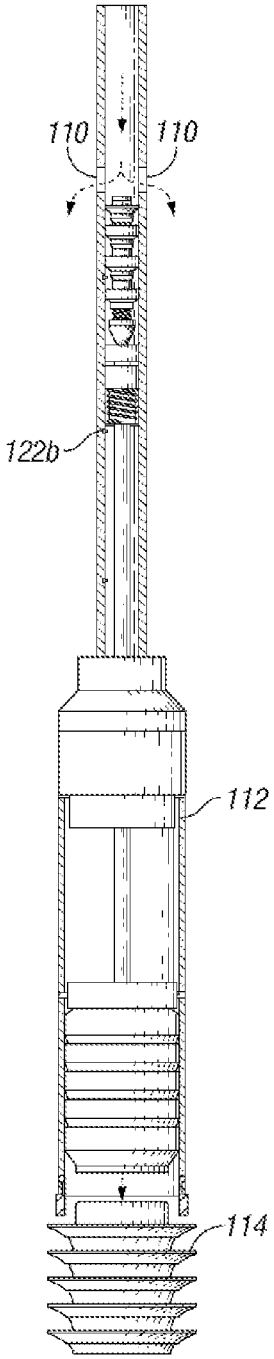
Figure 8:
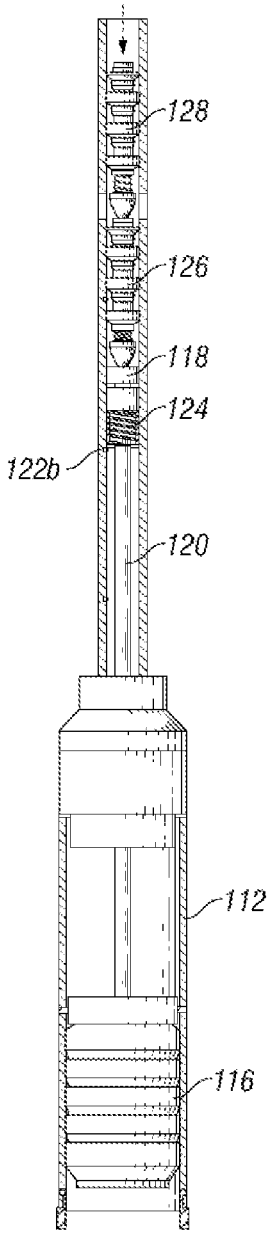
Figure 9:
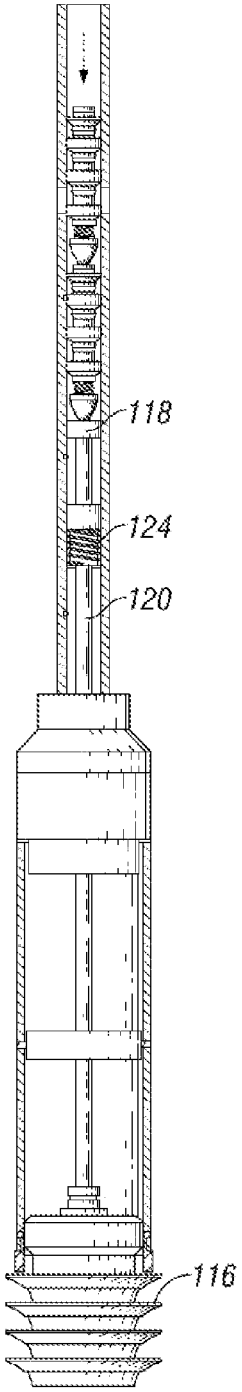
Figure 10:
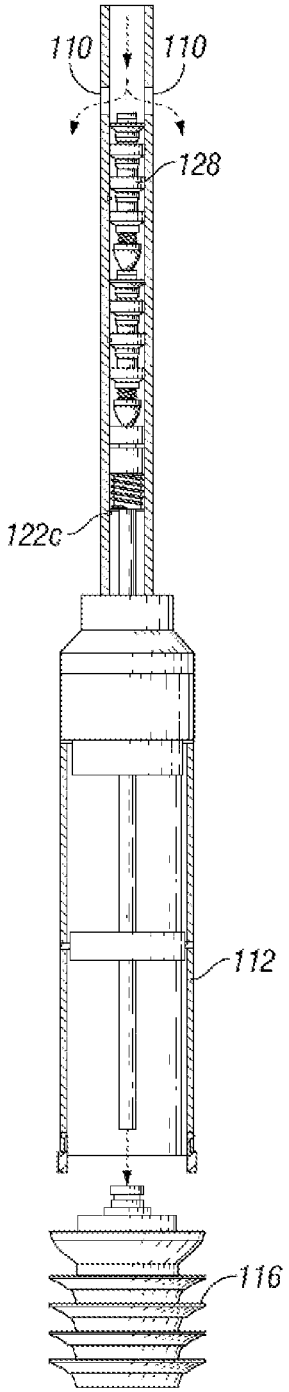

FIG. 4 shows a dashpot cartridge for use in the invention. This comprises a resilient body 100 having a central bore (not shown) through which an actuator rod can project as will be described below. Upper and lower flanges 102, 104 are provided at the top and bottom of the body 100 and a coil compression spring 106 is wound around the outside of the body between the flanges.

FIGS. 5-10 show the different stages of operation of a plug launching apparatus according to the invention. The apparatus comprises a cylinder 108 that can be connected at its upper end to a drill pipe or the like (not shown) extending from the surface of a well to a downhole location. A series of ports 110 are provided part way along the cylinder. The lower end of the cylinder 108 is connected to a plug basket 112 containing two cementing plugs 114, 116. A sliding piston 118 is located in the cylinder 108 below the ports 110 and an actuator rod 120 extends from the piston 118 into the plug basket 112. Movement of the piston 118 will be transmitted by the actuator rod 120 to the plugs 114, 116 in the basket 112. A series of shear pins 122*a-c* are provided projecting into the bore of the cylinder 108 at different spaced locations. A dashpot cartridge 124 of the type described in relation to FIG. 4 is positioned around the actuator rod 120 such that it is free to slide, but its movement is limited by the inward projection of the shear pins 122. The dashpot is held just below the piston 118 by the upper set of shear pins 122*a*.

In use, a dart 126 (or similar device) is pumped from the surface down the drill pipe, fluid ahead of the dart exiting the cylinder through the ports 110, and the fins of the dart sealing the part of the drill pipe above the dart from that below it. Pumping continues until the head of the dart contacts the piston 118 and the piston is pushed down so as to contact the upper flange of the dashpot 122, the lower flange being held against the shear pin 122*a*. A spring in the head of the dart and the compressibility of the dashpot damps the impact of the dart but resists significant movement. Consequently, the pressure above the dart will rise as fluid continues to be pumped. This pressure rise can be detected at surface and used to indicate contact of the dart 126 with the piston 118. Pumping continues such that the pressure applied to the shear pin 122*a* via the dart 126, piston 118 and dashpot 124 exceeds is strength and it breaks. At this point, the dashpot 124 is then free to slide down the actuator rod 120 and the piston 118 and rod 120 start to move, pushing the lowermost plug 114 from the basket 112 (see FIG. 6). The fins of the dart 126 are still sealing the bore of the drill pipe from the ports 110 so further pumping will continue to move the dart 126. Pumping continues until the dart 126 passes below the ports 110 and the plug 114 is fully ejected from the basket 112. At this point, the dashpot sits on the second set of shear pins 122*b* in an intermediate position and flow resumes through the ports 110 which are reopened (see FIG. 7). This will be detected at surface by a corresponding drop in fluid pressure.

When it is desired to eject the second plug 116 from the basket 112, a further dart 128 is pumped from the surface in the same manner as described above. The head of the further dart 128 engages the tail of the first dart 126 and pushes it, and the piston 118 forward compressing the dashpot 124 until sufficient pressure builds to shear the second set of pins 122*b* (see FIG. 8). At this point, the dashpot slides down the rod 120 as before, and the piston 118 advances the rod 120 to force the second plug 116 from the basket 112 (see FIG. 9). This motion continues until the second plug 116 is completely ejected from the basket 112, at which point, the dashpot is resting on the lower set of pins 122*c* and the second dart 128 is clear of the ports 110 (see FIG. 10).

When the tool is retrieved to the surface, it is a relatively easy job to re-set the piston and rod, as no fluid filled cylinders need to be re-set or re-charged. The dashpot can be simply replaced, if necessary and a new set of shear pins installed in the cylinder. Assembly or reconditioning of the dashpot can take place off site making setup at the rig site a relatively simple operation of assembling the necessary parts.

The effect of the dashpot spring mounting of the head of the darts act to cushion the impact of the dart on the piston yet still gives a positive indication in the pressure monitored at the surface allowing detection of the contact and motion of the piston in the ejection process.

Various changes can be made within the scope of the invention. For example, if more than two plugs are to be launched, a corresponding number of sets of pins can be installed at suitable positions in the cylinder. The darts can be replaced by other release mechanisms such as balls. Other such changes will be apparent.

The invention claimed is:

1. An apparatus for use in launching cement plugs in a well cementing operation, comprising:

a cylinder having an inner wall;

a piston slideably received in a bore of the cylinder; and an actuator extending from the piston through the cylinder and operable by the piston for launching a plug from the apparatus into the well;

wherein, a resilient damper cartridge installed at a first position is slideably mounted on the actuator in the cylinder so as to be contactable by the piston, and at least three sets of frangible pins are located at least three positions along the cylinder wall so as to provide temporary limits to the movement of the cartridge in the cylinder as the piston slides along the cylinder, wherein, after sliding past a first set of frangible pins, the cartridge advances to a second set of frangible pins.

2. The apparatus as claimed in claim 1, further comprising a basket that houses at least two cement plugs, the pins being positioned so as to limit movement of the cartridge after each plug is launched from the basket.

3. The apparatus as claimed in claim 2, wherein the pins can be replaced after use.

4. The apparatus as claimed in claim 2, wherein the piston is configured to move from a first position in which the plugs are located in the basket to an intermediate position in which a first plugs has been ejected from the basket; and from the intermediate position to a final position in which a second plug has been ejected from the basket; the pins being positioned so as to temporarily hold the piston at the first, intermediate and second positions until sheared by application of pressure to the piston.

5. The apparatus as claimed in claim 4, further comprising a connection for a tubular pipe such that one or more darts can be pumped into contact with the piston to apply pressure thereto.

6. A method of using a resilient damper cartridge in an apparatus for launching cement plugs in a well cementing operation, comprising:

assembling an apparatus comprising (1) a cylinder having an inner wall, (2) a piston slideably received in a bore of the cylinder, (3) an actuator extending from the piston through the cylinder and operable by the piston for launching a plug from the apparatus into the well, (4) the damper cartridge which is slideably mounted on the actuator in the cylinder so as to be contacted by the piston, (5) at least three sets of frangible pins located at least three positions along the cylinder wall that provide temporary limits to cartridge movement, and (6) at least a bottom cementing plug and a top cementing plug;

installing the damper cartridge at a first position above a first set of frangible pins;

pumping a first fluid into the apparatus;

placing and pumping a bottom dart into the apparatus;

pumping a second fluid into the apparatus behind the bottom dart;

allowing the bottom dart to contact the damper cartridge, thereby exerting a downward force on the cartridge;

allowing the first set of frangible pins to fail, thereby causing the damper cartridge to advance to and stop at a second set of frangible pins, thereby causing the piston to expel the bottom plug from the apparatus.

7. The method of claim 6, wherein the cartridge comprises an upper flange that in use is contacted by the piston, and a lower flange that contacts the pins as the cartridge moves along the cylinder.

8. The method of claim 7, wherein the cartridge further comprises a compression spring wound around the cartridge between the two flanges.

9. The method of claim 6, wherein the apparatus further comprises a basket that houses at least two cement plugs, the pins being positioned so as to limit movement of the cartridge after each plug is launched from the basket.

10. The method of claim 9, wherein the pins can be replaced after use.

11. The method of claim 9, wherein the piston is configured to move from a first position in which the plugs are located in the basket to an intermediate position in which a first plugs has been ejected from the basket; and from the intermediate position to a final position in which a second plug has been ejected from the basket; the pins being positioned so as to temporarily hold the piston at the first, intermediate and second positions until sheared by application of pressure to the piston.

12. The method of claim 11, wherein the apparatus further comprises a connection for a tubular pipe such that one or more darts can be pumped into contact with the piston to apply pressure thereto.

13. A method for separating fluids in a well comprising:

assembling an apparatus comprising (1) a cylinder having an inner wall, (2) a piston slideably received in a bore of the cylinder, (3) an actuator extending from the piston through the cylinder and operable by the piston for launching a plug from the apparatus into the well, (4) the damper cartridge which is slideably mounted on the actuator in the cylinder so as to be contacted by the piston, (5) at least three sets of frangible pins located at least three positions along the cylinder wall that provide temporary limits to cartridge movement, and (6) at least a bottom cementing plug and a top cementing plug;

installing the damper cartridge at a first position above a first set of frangible pins;

pumping a first fluid into the apparatus;

placing and pumping a bottom dart into the apparatus;

pumping a second fluid into the apparatus behind the bottom dart;

allowing the bottom dart to contact the damper cartridge, thereby exerting a downward force on the cartridge;

allowing the first set of frangible pins to fail, thereby causing the damper cartridge to advance to and stop at a second set of frangible pins, thereby causing the piston to expel the bottom plug from the apparatus.

14. The method of claim 13, wherein the apparatus further comprises a basket that houses the cement plugs, the pins being positioned so as to limit movement of the cartridge after each plug is launched from the basket.

15. The method of claim 14, wherein the pins can be replaced after use.

16. The method of claim 14, wherein the piston is configured to move from a first position in which the plugs are located in the basket to an intermediate position in which a first plug has been ejected from the basket; and from the intermediate position to a final position in which a second plug has been ejected from the basket; the pins being positioned so as to temporarily hold the piston at the first, intermediate and second positions until sheared by application of pressure to the piston.

17. The method of claim 16, further comprising a connection for a tubular pipe such the one or more darts can be pumped into contact with the piston to apply pressure thereto.

18. The method of claim 13, wherein the cartridge comprises a resilient body having a central bore through which the actuator can project, and further including upper and lower contact surfaces for contacting the piston and pins respectively.

19. The method of claim 18, wherein the cartridge comprises an upper flange that in use is contacted by the piston, and a lower flange that contacts the pins as the cartridge moves along the cylinder.

20. The method of claim 19, wherein the cartridge further comprises a compression spring wound around the cartridge between the two flanges.

* * * * *